US005390931A

United States Patent [19]

Chiasson

[11] Patent Number: 5,390,931

[45] Date of Patent: Feb. 21, 1995

[54] GOLF BALL TEE DEVICE

[76] Inventor: Maurice J. Chiasson, 46 Brek Dr., Merrimack, N.H. 03054

[21] Appl. No.: 230,210

[22] Filed: Apr. 20, 1994

[51] Int. Cl.[6] ..... A63B 69/36

[52] U.S. Cl. ..... 273/201

[58] Field of Search ..... 273/33, 201, 202

[56] References Cited

U.S. PATENT DOCUMENTS

| | | | |
|---|---|---|---|
| 1,965,697 | 7/1934 | Gardner et al. | 273/201 |
| 2,450,206 | 9/1948 | Shouse | 273/201 |
| 3,147,980 | 9/1964 | Gollahon | 273/201 |
| 4,934,697 | 6/1990 | Shiau Ruey | 273/201 |
| 5,282,629 | 2/1994 | Eckstein | 273/201 |
| 5,322,291 | 6/1994 | Smith et al. | 273/201 |

FOREIGN PATENT DOCUMENTS

| | | | |
|---|---|---|---|
| 2231803 | 11/1990 | United Kingdom | 273/201 |

*Primary Examiner*—William E. Stoll

*Attorney, Agent, or Firm*—Edward R. Hyde

[57] ABSTRACT

An automatic golf ball teeing device in which golf balls are fed to a tee for driving. The device is in the form of a portable platform that may be moved to desired locations. The design of the automatic golf ball feeding mechanism permits a shallow platform raised a minimum amount above the ground.

10 Claims, 6 Drawing Sheets

GOLF BALL TEE DEVICE

BACKGROUND OF THE INVENTION

1. Field of the Invention

The present invention relates to an automatic golf tee device of the type that would be used at golf driving ranges. More particularly, the invention is a portable semiautomatic golf tee mechanism that may be conveniently moved from one location to another. In operation, it feeds a series of golf balls to a tee from which they may be driven by the golfer. Thus it is unnecessary for the golfer to manually place a ball on a tee after each drive as is conventional in most golf practice driving ranges.

2. Description of the Prior Art

Automatic golf tee's exist and are found at some driving ranges. Such devices may be categorized as underground and aboveground type depending on the location of the golf ball feeding mechanism. The aboveground supply type of device is shown, for example, in U.S. Pat. No. 3,901,515 of Mozel. This type of mechanism in which the ball supply is aboveground and exposed has various disadvantages including that of being distractive to the golfer. Further, the aboveground track that directs the balls is subject to being inadvertently impacted or hit because of its exposure aboveground alongside of an area of golf ball driving activity.

Other devices employ the underground ball supply which are usually deep into the ground where the balls follow a path to a point where they are brought onto the golf tee when the device is actuated by the golfer. Disadvantages of this type of device is that it requires excavation of the area and resulting difficulty of locating and relocating to other places. This type of device is found in U.S. Pat. No. 2,295,599 of Mozel, No. 3,294,402 of Scott, No. 3,423,097 of Fry, and No. 2,966,213 of Bradley.

These Prior Art Devices have additional drawbacks as, for example, the arrangement for adjusting the height of the tee. On some such devices, the tee height is changed by replacing the tee with one of a different height which, of course, is a cumbersome manner of height adjustment. On other prior devices, the height adjustment is not known until after full cycle of the device, that is the user cannot adjust the height of the tee up and down while the machine is not being used.

It is to these and other disadvantages of the prior art devices that the present invention is directed.

SUMMARY OF THE INVENTION

The present invention provides a self-contained portable teeing device that may be conveniently located at any desired location without the necessity of excavation or other significant site preparation. The device includes a platform upon which the golfer may stand and a golf tee, ball supply and convenient mechanism for automatically placing the golf balls on the tee. Further, there is convenient mechanism for adjusting the tee height to suit various individual golfers.

The portable platform may be of square shape and have a depth of little more than twice the diameter of a golf ball. The latter is an especially unique feature in that it permits the device to be low and close to the ground upon which it is located. The supply of golf balls are fed through a tube to an elevating device that serves to place them individually, serially on the tee from which the golfer drives each ball. The mechanism for bringing a new ball into position is initiated by the golfer stepping on a value pin conveniently located next to the platform surface.

Against the foregoing background, it is a primary object of the present invention to provide a portable semi-automatic golf tee that is conveniently installed by simple placement in a desired location and which is efficient and convenient in operation.

It is a further object of the present invention provide a portable golf tee that includes a platform upon which the golfer stands in driving the golf balls from a tee located on the platform and in which the supply of golf balls is fed along a track located within the platform.

Another object of the present invention is to provide a portable golf tee of platform construction of shallow depth so that when it is in position the top of the platform upon which the golfer stands is raised only a small distance above the terraine upon which the device rests.

A still further object of the present invention is to provide an efficient, reliable and easily operated portable golf tee that may be readily located in different positions.

BRIEF DESCRIPTION OF THE DRAWINGS

The foregoing and still other objects and advantages of the present invention will be more apparent from the following detailed explanation of the preferred embodiments of the invention considered in connection with the accompanying drawings herein in which.

DESCRIPTION OF THE PREFERRED EMBODIMENT

Figure 1:
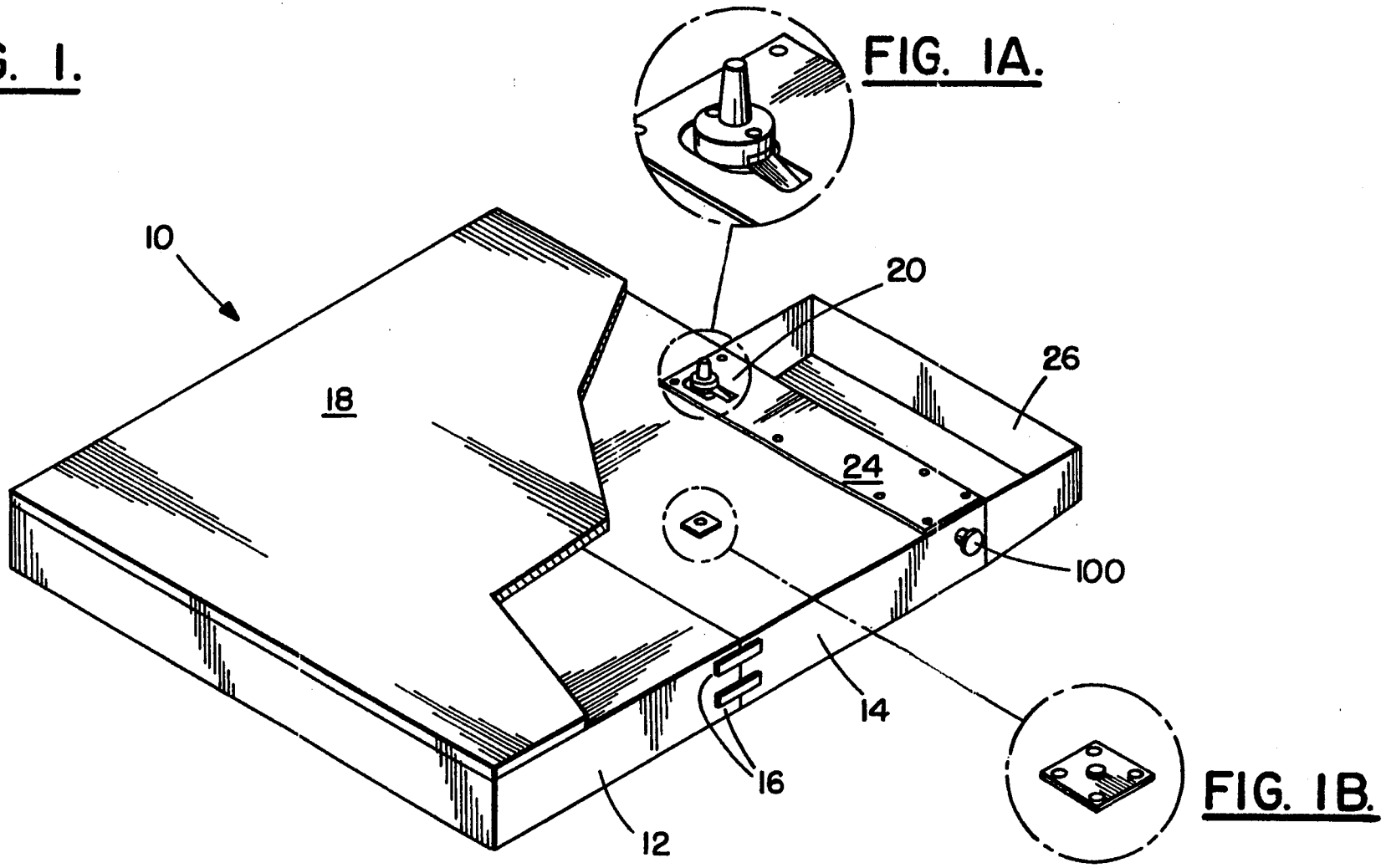
FIG. 1 is a prospective view of the portable golf tee device of the present invention.

Referring now to the drawings and more particularly to FIG. 1, 10 indicates a platform which may be made of any convenient material such as a wooden frame and may comprise two sections 12, 14 conveniently hinged together. The double section arrangement permits easy portability. When the sections are in the open, operative position, they are held together by straps 16. The platform is covered by a thick matt 18 which simulates the fairway of a golf course and is shown partially cut away in FIG. 1.

The golf tee 20 upon which the golf balls are placed and from which they are driven projects up through the platform and matt and is located toward one edge of the platform. The tee and its associated ball feeding mechanism is located in a compartment 22 having a top plate 24 secured to the platform 10. A golf ball bin 26 is conveniently located adjacent to the compartment 22 and serves as a supply of golf balls.

Figure 2:
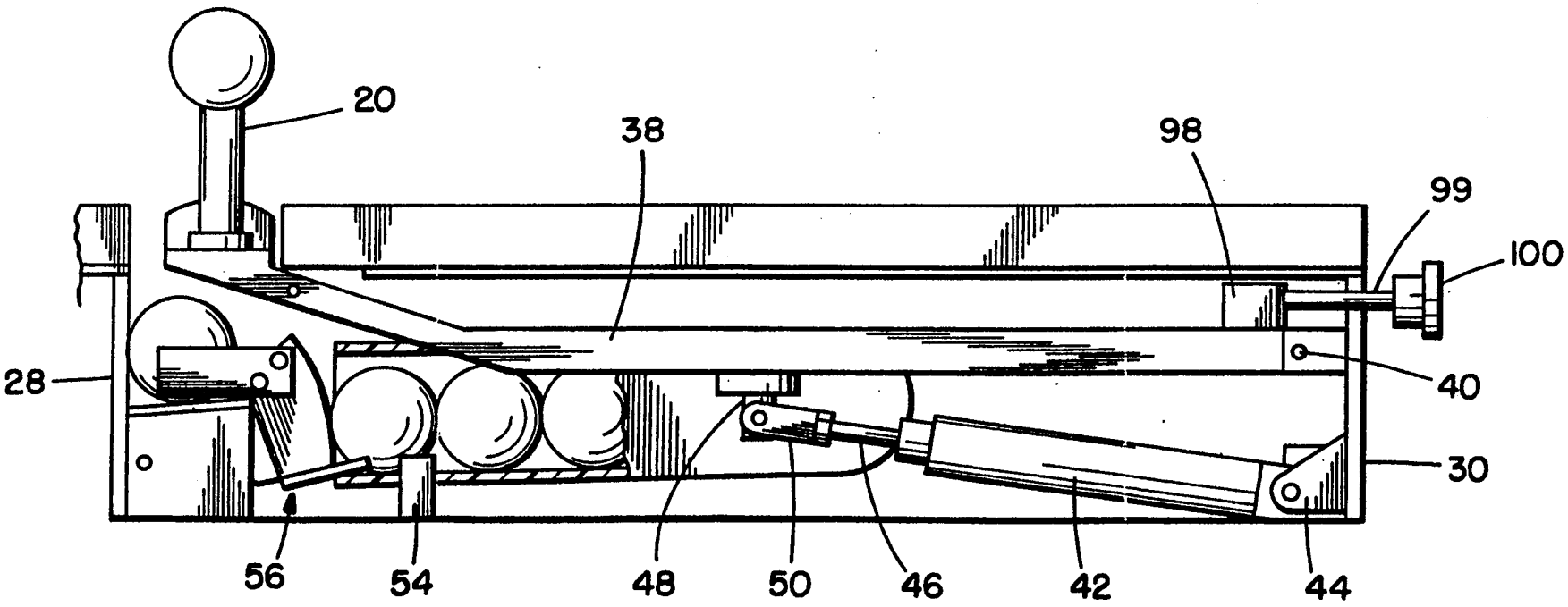
FIG. 2 is a sectional elevational view of the golf tee and ball feeding mechanism.
Figure 3:
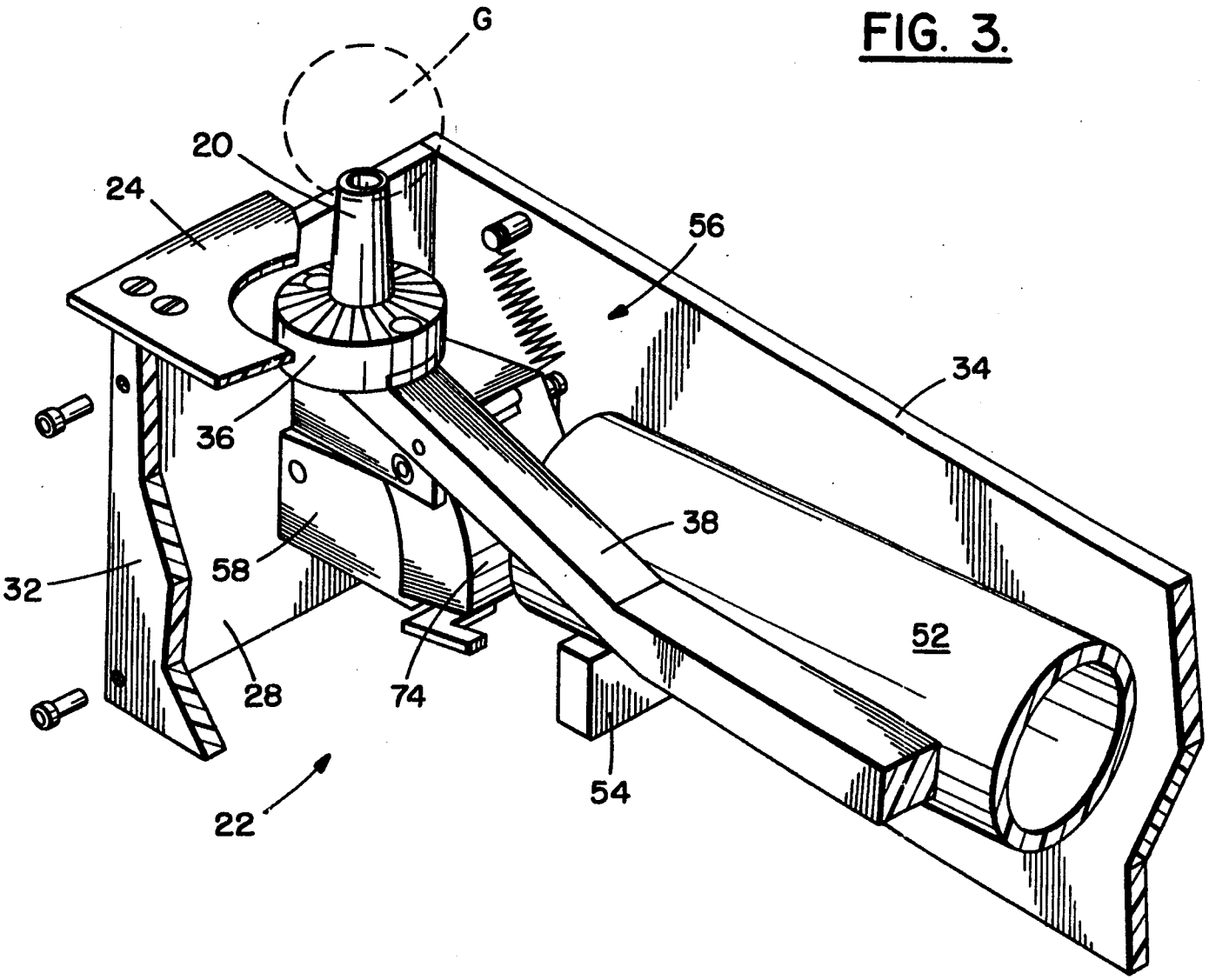
FIG. 3 is a prospective view of the mechanism of FIG. 2.
Figure 4:
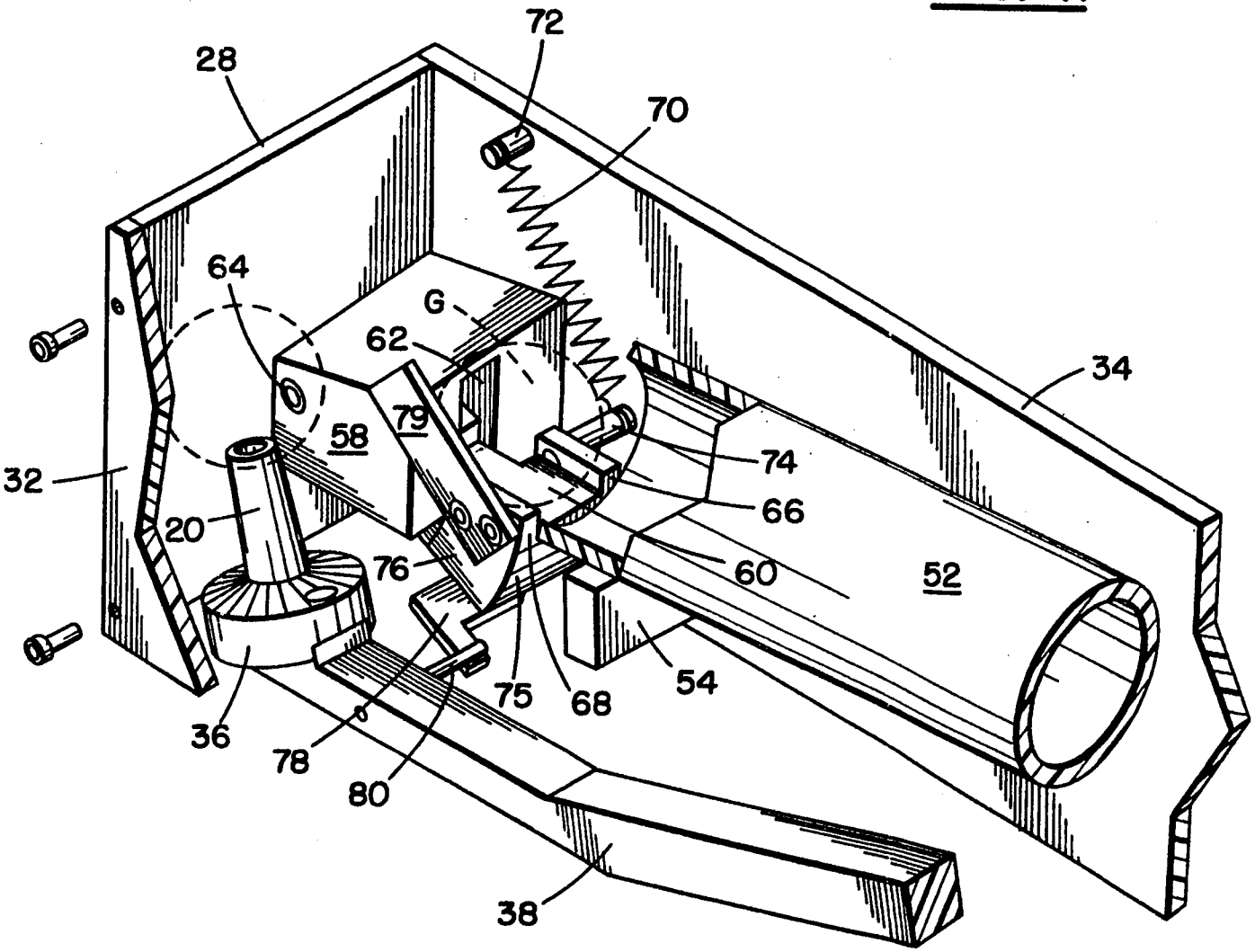
FIG. 4 is a prospective view similar to FIG. 3 but with the tee and golf ball elevator in their lowered position.

The ball feeding mechanism is shown more clearly in FIGS. 2, 3, and 4 where it is seen that the mechanism is located within the compartment 22 formed of front end plate 28, rear end plate 30 and sideplates 32, 34. The tee 20 of conventional rubber construction is secured to a tee base 36 which in turn is secured to one end of a pivotally mounted tee lever arm 38 the opposite end of which receives a pivot pin 40 that, in turn, is anchored to side plates 32, 34 of the mechanism compartment 22. In this manner it is seen that the tee 20 may be raised and lowered by the pivoting of the tee arm 38 about its pivot 40. The pivoting movement is controlled by a cylinder mechanism 42, one end of which is secured to back plate 30 by bracket 44. A piston arm 46 is suitably coupled to the underside of lever arm 38 by clevis bracket 48 and rod clevis 50.

Figure 5:
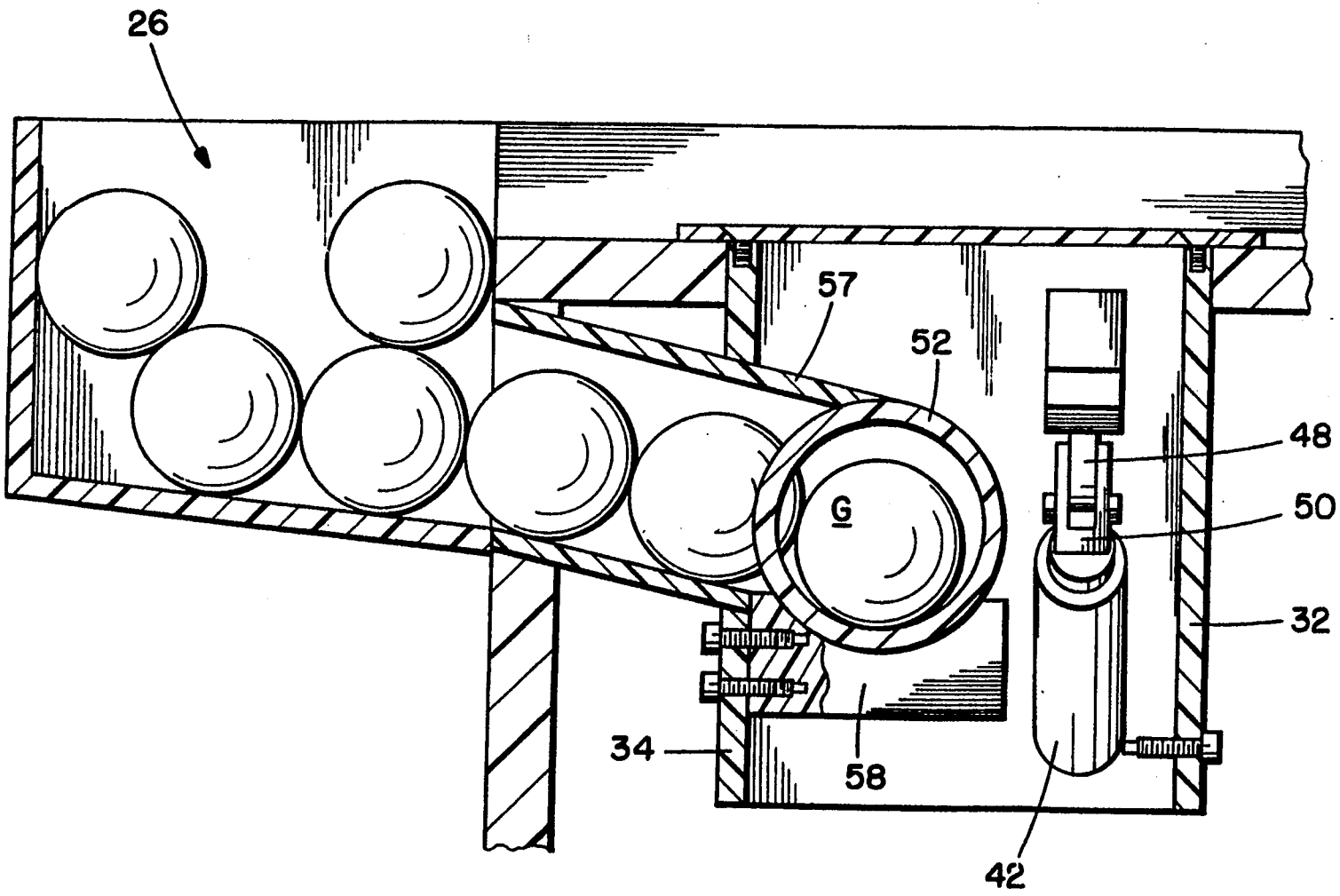
FIG. 5 is a sectional end view of the drive mechanism.

An inclined tube 52 is provided within the compartment 22 and secured in place in any convenient manner as by bracket 54 to direct the golf balls to an elevator mechanism generally indicated 56 hereinafter to be described. The front end of the tube terminates directly in front of the elevator mechanism 56 and the rear end of the tube connects to an elbow tube 57 that as seen in FIG. 5 passes through wall 34 into ball bin 26. Thus the golf balls in the bin are continually fed to the feeding tube 52.

The elevator mechanism 56 comprises a hollow block 58 secured in any convenient manner to the front plate 28 of the compartment. An elevator 60 includes an arm extending through a slot 62 in the front of the block 58 and secures to an elevator pin 64 which in turn is secured to the side members of block 58. As seen in FIG. 4, the elevator 60 includes two upstanding bosses 66, 68 that receive a golf ball G when the elevator is in its down position as seen in FIG. 4. In this position, the golf ball rests between the bosses on the top of the elevator arm and rests against the forward end of block 58. The elevator is constantly urged in its upward or elevated position by coil spring 70 anchored to pin 72 in side plate 34 and to pin 74 secured to elevator arm 60.

Depending from elevator arm 60 is a structure consisting of front retainer plate 75 having side members 76 which are raised and lowered as elevator arm pivots upward and downward. Secured to the bottom of the elevator arm is a lever plate 78 that cooperates with lever pin 80 secured to lever arm 38. Thus as lever arm is pivoted upward under control of the piston 42, pin 80 raises and the elevator mechanism 60 pivots upward under the control of coil spring 70. Conversely, when lever arm 38 pivots downward pin 80 exerts a downward force on lever plate 78 to pivot the elevator mechanism downward. The upward position of lever arm 38 and the elevator mechanism is shown in FIG. 3 whereas the downward position is illustrated in FIG. 4.

Figure 6:
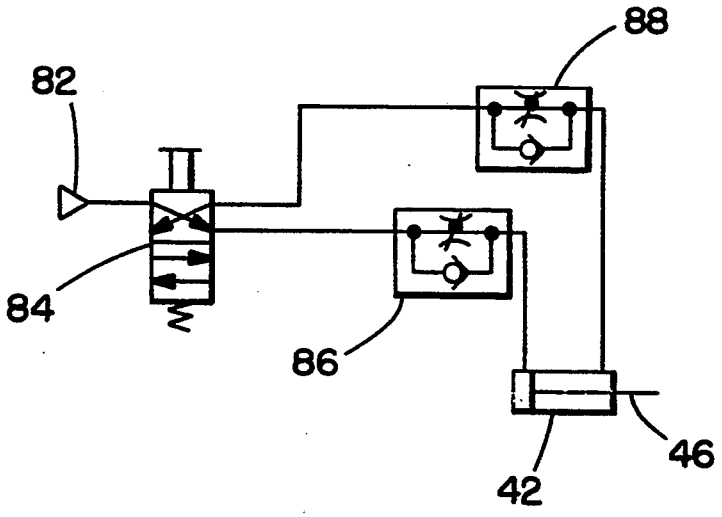
FIG. 6 is a pneumatic schematic of the actuating mechanism.
Figure 7:
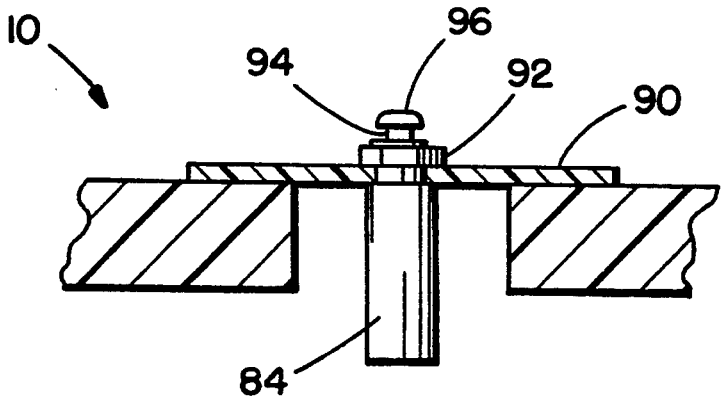
FIG. 7 is a sectional view of the actuator valve located in the platform.

The piston for controlling the mechanism is part of a pneumatic system shown in FIG. 6. A source of compressed air 82 connects to a valve 84 and to the piston mechanism 42 through two flow control valves 86, 88. Valve 84 is located in platform 10 as seen in FIGS. 1 and 7. The valve may be secured in place by a plate 90 and securing nut 92. The actuator stem 94 having a cap 96 extends above the platform and under the matt 18. The location of valve 84 on platform 10 is convenient for the golfer to actuate with his foot simply by stepping on the matt 18 directly over the actuator 94. A suitable mark may be inscribed on the top of the matt to indicate the actuating location.

The mechanism operates in the following manner. After the golfer has driven the golf ball off the tee, he will step on valve actuator 94 to open valve 84 thereby actuating the piston in cylinder mechanism 42. Piston arm 46 is thereby retracted to pivot lever arm 38 downward about its pivot point 40. As the lever arm descends the lever pin 80 bearing against lever plate 78 lowers the elevator mechanism 60 against coil spring 70 and a golf ball at the end of tube 52 will roll forward under gravity to a position between bosses 66, 68 of the elevator mechanism. When the elevator is pivoted downward, retainer plate 79 permits a golf ball that had been resting on the top of block 58 to roll sideways onto tee 20. It is understood that the top of block 58 has a compound incline in that it angles downward in the forward direction away from the tube and also to the left as viewed in FIGS. 3 and 4.

Upon the release of the piston mechanism, the lever arm pivots upward to locate the tee above the platform in a position for the golfer to hit the ball located on the tee. At the same time that the lever arm 38 pivots upward, the elevator mechanism raises the golf ball that is located between bosses 66, 68 to a point that it rolls upon the top of block 58 and retained in place by retainer plate 79. FIG. 3 illustrates the upward position of the mechanism where it is seen that the tee with the golf ball G is in position for the golfer to hit and another golf ball (not shown) would be located on the top of block 58. The next ball in the end of tube 52 is held in place in the tube by member 75.

To accommodate different golfers who desire various tee heights, a mechanism is provided to limit the upper movement of lever arm 38 and which mechanism is adjustable. Thus as seen in FIG. 2 a block 98 is secured to the top of lever arm 38 in any suitable manner and controlled by a screw 99 passing,through the end plate 30 of compartment 22. Screw 99 may be manually adjusted by knob 100 to move stop 98 to a desired position and thus limit the upward pivoting of lever arm 30. This in turn determines the upward extent of pivoting of the lever arm and has the height of tee 20.

Having thus described the invention with particular reference to the preferred forms thereof, it will be obvious that various changes and modifications may be made therein without departing from the spirit and scope of the invention as defined in the appended claims.

What is claimed is:

1. A golf ball teeing device comprising;

a platform upon which a golfer stands to hit a golf ball;

said platform being of shallow depth and having a compartment for housing an automatic teeing device;

said automatic teeing device being located in said compartment comprising;

an inclined tube adapted to receive a series of golf balls;

an elevator mechanism located adjacent the lower end of said inclined tube;

a lever arm extending generally parallel to the inclined tube and alongside thereof;

said lever arm being pivoted at one end thereof;

golf ball teeing means secured to said lever arm;

said elevator mechanism including means to receive a golf ball from said inclined tube;

support means to receive a golf ball from said elevator mechanism;

said elevator mechanism being operable to raise a golf ball to said support means;

means to pivot said lever arm to lower the teeing means;

means to move a golf ball from the support means to the teeing means in its lower position; and means to pivot said lever arm to raise the teeing means with the golf ball thereon to a position above said platform.

2. The device set forth in claim 1 in which said elevator mechanism is spring urged to a raised position and includes means to retain golf balls in the inclined tube when in said raised position.

3. The device set forth in claim 2 including means to lower the elevator mechanism to a depressed position to receive a golf ball from said inclined tube.

4. The device set forth in claim 3 in which said means to lower the elevator mechanism is responsive to the means to pivot the lever arm whereby pivoting of the lever arm to lower the teeing means results in lowering the elevator mechanism to release a golf ball from the inclined tube to said means to receive a golf ball.

5. The device set forth in claim 4 in which the means to pivot the lever arm includes a pneumatic system.

6. The device set forth in claim 5 in which the pneumatic system includes a piston mechanism and actuating valve.

7. The device set forth in claim 1 in which said means to move a golf ball from the support means includes a compound inclined surface.

8. The device set forth in claim 7 in which said elevator mechanism includes a retaining means to retain a golf ball on the support means when the elevator mechanism is in its raised position and the teeing means is located above the platform.

9. A golf ball teeing device comprising:

a platform upon which a golfer stands to hit a golf ball;

said platform being of shallow depth and having a compartment for housing an automatic teeing device;

an automatic teeing device located in said compartment comprising;

an inclined tube adapted to receive a series of golf balls;

pivoting elevator means located adjacent the lower end of the inclined tube and adapted to be pivoted to a raised position and to a lowered position;

lever arm means extending generally parallel to the inclined tube and alongside thereof;

said lever arm means being pivoted at one end thereof;

golf ball teeing means secured to said lever arm means at the other end thereof whereby the teeing means is moved to a lower position and higher position upon pivoting of the lever arm means;

said elevator means including means to receive a golf ball from the inclined tube;

support means having a compound incline to receive a golf ball from said elevator means;

said elevator means being operable to raise a golf ball received from the inclined tube to said support means;

means to pivot the lever arm means to selectively raise and lower the teeing means;

spring means connected to urge the elevator to a raised position;

retaining means to retain a golf ball on the support means when the elevator means is in its raised position;

actuating means connected to the pivoting elevator means and to the lever arm means to pivot the elevator means to its lower position when the lever arm means is pivoted to its lower position whereby a golf ball from the inclined tube is received by the elevator means and a golf ball from the support means is received by the teeing means; and means whereby the teeing means is above the platform when the teeing means is in its raised position.

10. The device set forth in claim 9 including:

a pneumatic system to pivot the lever arm means;

said pneumatic system including a cylinder means;

valve means to selectively actuate the cylinder means; and foot operated means extending through said platform to operate the valve means.

* * * * *